US007476089B2

(12) United States Patent
Kim

(10) Patent No.: US 7,476,089 B2
(45) Date of Patent: Jan. 13, 2009

(54) SCROLL COMPRESSOR HAVING OVERHEAT PREVENTING UNIT

(75) Inventor: Su-Chul Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 569 days.

(21) Appl. No.: 11/013,350

(22) Filed: Dec. 17, 2004

(65) Prior Publication Data

US 2005/0135939 A1 Jun. 23, 2005

(30) Foreign Application Priority Data

Dec. 19, 2003 (KR) ..... 10-2003-0094026

(51) Int. Cl.
*F04B 49/00* (2006.01)

(52) U.S. Cl. ..... 417/292; 236/93 R

(58) Field of Classification Search ..... 417/32, 417/292, 283; 236/93 R, 101 R
See application file for complete search history.

(56) References Cited

U.S. PATENT DOCUMENTS

| | | | | | |
|---|---|---|---|---|---|
| 2,099,643 | A | * | 11/1937 | Werring | 236/92 C |
| 3,403,238 | A | * | 9/1968 | Buehler et al. | 337/393 |
| 4,570,851 | A | * | 2/1986 | Cirillo | 236/93 R |
| 5,141,407 | A | * | 8/1992 | Ramsey et al. | 417/292 |
| 5,167,491 | A | * | 12/1992 | Keller et al. | 417/28 |
| 5,186,613 | A | * | 2/1993 | Kotlarek et al. | 417/291 |
| 5,248,244 | A | | 9/1993 | Ho et al. | |
| 5,290,154 | A | * | 3/1994 | Kotlarek et al. | 417/292 |
| 5,452,989 | A | * | 9/1995 | Rood et al. | 417/29 |
| 5,527,158 | A | * | 6/1996 | Ramsey et al. | 417/32 |
| 5,607,288 | A | | 3/1997 | Wallis et al. | |
| 5,707,210 | A | | 1/1998 | Ramsey et al. | |
| 6,210,120 | B1 | * | 4/2001 | Hugenroth et al. | 417/32 |
| 6,267,565 | B1 | * | 7/2001 | Seibel et al. | 417/292 |
| 6,615,594 | B2 | * | 9/2003 | Jayanth et al. | 62/126 |
| 6,685,441 | B2 | * | 2/2004 | Nam | 417/292 |
| 2004/0115063 | A1 | * | 6/2004 | Hong et al. | 417/32 |

FOREIGN PATENT DOCUMENTS

| | | | |
|---|---|---|---|
| JP | 6-26402 | A | 2/1994 |
| JP | 6-26472 | A | 2/1994 |
| JP | 2001-147072 | A | 5/2001 |
| JP | 2001-227489 | A | 8/2001 |
| JP | 2003-139069 | A | 5/2003 |
| KR | 1994-0015284 | A | 7/1994 |
| KR | 97-008003 | B1 | 5/1997 |

* cited by examiner

*Primary Examiner*—Charles G Freay
(74) *Attorney, Agent, or Firm*—Birch, Stewart, Kolasch & Birch, LLP

(57) ABSTRACT

A scroll compressor having an overheat preventing unit includes a casing; a driving motor installed in the casing and generating a driving force; a compression unit connected with the driving motor by a rotating shaft, and compressing a fluid and discharging it externally when the driving motor is driven; and an overheat preventing unit installed at one side of the compression unit and sensing a temperature of a gas compressed in a compressing chamber of the compression unit, and bypassing a high temperature and high pressure gas of a high pressure chamber to a low pressure chamber if the sensed temperature of the gas goes up beyond a pre-set value.

10 Claims, 4 Drawing Sheets

SCROLL COMPRESSOR HAVING OVERHEAT PREVENTING UNIT

BACKGROUND OF THE INVENTION

1. Field of the Invention

The present invention relates to an overheat preventing unit of a scroll compressor and, more particularly, to a scroll compressor having an overheat preventing unit capable of enhancing reliability of a compressor and protecting the compressor by bypassing a high temperature and high pressure gas of a high pressure chamber to a low pressure chamber when internal temperature of the compressor goes beyond a pre-set temperature.

2. Description of the Background Art

In general, various types of compressors can be employed according to a compression method, and for an air-conditioner that requires a small and light compressor, a scroll compressor is commonly used.

FIG. 1 is a sectional view of a scroll compressor in accordance with a conventional art.

The conventional scroll compressor includes: a casing 106 having a certain closed space, to which a suction pipe 102 for sucking a fluid and discharge pipe 104 for discharging a compressed fluid are connected, a driving unit 108 disposed at a lower portion of the casing 106 and generating a driving force; and a compressing unit 110 disposed at an upper portion of the casing 106 and connected to the driving unit 108 by a rotating shaft 112 to compress the fluid sucked into the suction pipe 102 according to rotation of the rotating shaft 112 and discharge it through the discharge pipe 104.

A main frame 114 for rotatably supporting the upper portion of the rotating shaft 112 and the compressing unit 110 is installed at the upper portion of the casing 106, and a lower frame 116 for rotatably supporting a lower portion of the rotating shaft 112 is installed at the lower portion of the casing.

The driving unit 108 includes a stator 122 fixed in a circumferential direction of the casing 106 and a rotor 124 disposed at an inner circumferential surface of the stator 122 and fixed at the rotating shaft 112. When power is applied to the stator 122, the rotor 124 is rotated according to interaction between the stator 122 and the rotor 124, rotating the rotating shaft 112.

The compressing unit 110 includes a fixed scroll 128 having a fixed wrap 126 in an involute shape and fixed at an upper portion of the casing 106, and a orbiting scroll 132 having an orbiting wrap 130 in the involute shape corresponding to the fixed wrap 126 to have a certain compression chamber 118 therebetween, orbitally supported by the main frame 114, and orbiting when the rotating shaft 112 is rotated.

A discharge passage 136 is formed at the center of the fixed scroll 128 in order to discharge a fluid after being compressed in the compressing chamber 118 according to the interaction between the fixed wrap 126 and the orbiting wrap 130, and a chuck valve 138 is installed at an upper side of the discharge passage 136 in order to prevent backflow of discharged fluid.

A muffler 140 is mounted at an upper side of the fixed scroll 128 in order to reduce noise of a gas being discharged to the discharge passage 136, and an oldhamring 150 for preventing rotation of the orbiting scroll 132 is installed between the orbiting scroll 132 and the main frame 114.

A temperature sensor (not shown) for sensing a temperature of a gas is installed at the discharge pipe 104 which is connected in or to a high pressure chamber 142 into which a compressed gas flows after being formed by the muffler 140 and discharges the compressed gas. Thus, when a temperature inside the high pressure chamber 142 goes up beyond a pre-set value, the temperature sensor cuts off power being applied to the compressor to protect the compressor.

As mentioned above, the conventional scroll compressor operates as follows. That is, when power is applied to the stator 122, the rotor 124 is rotated according to interaction between the stator 122 and the rotor 124 and the rotating shaft 112 fixed at the rotor 124 is rotated in a forward direction. Then, the orbiting scroll 132 is orbitally moved according to the rotation of the rotating shaft 112 to interact with the fixed scroll 128 to compress the gas flowing into the compressing chamber 118. The compressed gas is introduced into the high pressure chamber 142 through the discharge passage 136, and then the gas introduced into the high pressure chamber is discharged externally through the discharge pipe 104.

At this time, the fluid discharged toward the high pressure side through the discharge passage 136 is prevented flowing back to the lower pressure side by the chuck valve 138.

However, because the conventional scroll compressor must include an electric circuit such as a temperature sensor for sensing the temperature of the high pressure chamber, fabrication cost increases. In addition, after the temperature of the high pressure chamber is sensed by the temperature sensor, driving of the compressor is stopped, causing a problem that operation delay may occur or malfunction is generated to damage the compressor.

SUMMARY OF THE INVENTION

Therefore, one object of the present invention is to provide a scroll compressor capable of protecting a compressor and protect the compressor by bypassing a gas inside a high pressure chamber to a lower pressure chamber if the gas being discharged goes up to an abnormally high temperature.

Another object of the present invention is to provide a scroll compressor having an overheat preventing unit capable of operating accurately and thus preventing damage to a compressor by operating the overheat preventing unit according to a temperature of a gas compressed in a compressing chamber.

To achieve these and other advantages and in accordance with the purpose of the present invention, as embodied and broadly described herein, there is provided a scroll compressor having an overheat preventing unit including: a casing; a driving motor installed in the casing and generating a driving force; a compression unit connected with the driving motor by a rotating shaft, and compressing a fluid and discharging it externally when the driving motor is driven; and an overheat preventing unit installed at one side of the compression unit and sensing a temperature of a gas compressed in a compressing chamber of the compression unit, and bypassing a high temperature and high pressure gas of a high pressure chamber to a low pressure chamber if the sensed temperature of the gas goes up beyond a pre-set value.

The overheat preventing unit includes a passage member disposed at an upper surface of a fixed scroll and having a bypass passage making the high pressure chamber and the low pressure chamber communicated with each other; and a valve assembly mounted at the fixed scroll, sensing a temperature of the gas compressed in the compressing chamber, and opening the bypass passage if the sensed gas temperature goes up beyond a pre-set temperature.

The valve assembly includes a channel formed at the fixed scroll and connected with the compressing chamber; a mounting groove communicating with the channel and formed at an upper surface of the fixed scroll; a thermally-distorted member installed in the mounting groove and thermally distorted when the temperature of the gas compressed in the compressing chamber goes up beyond the pre-set temperature; and a valve member mounted at the thermal distortion member and opening the bypass passage when the thermal distortion member is thermally distorted.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An overheat preventing unit of a scroll compressor in accordance with the present invention will now be described with reference to the accompanying drawings.

There can be several embodiments of the overheat preventing unit of the scroll compressor, the most preferred one of which will now be described.

Figure 1:
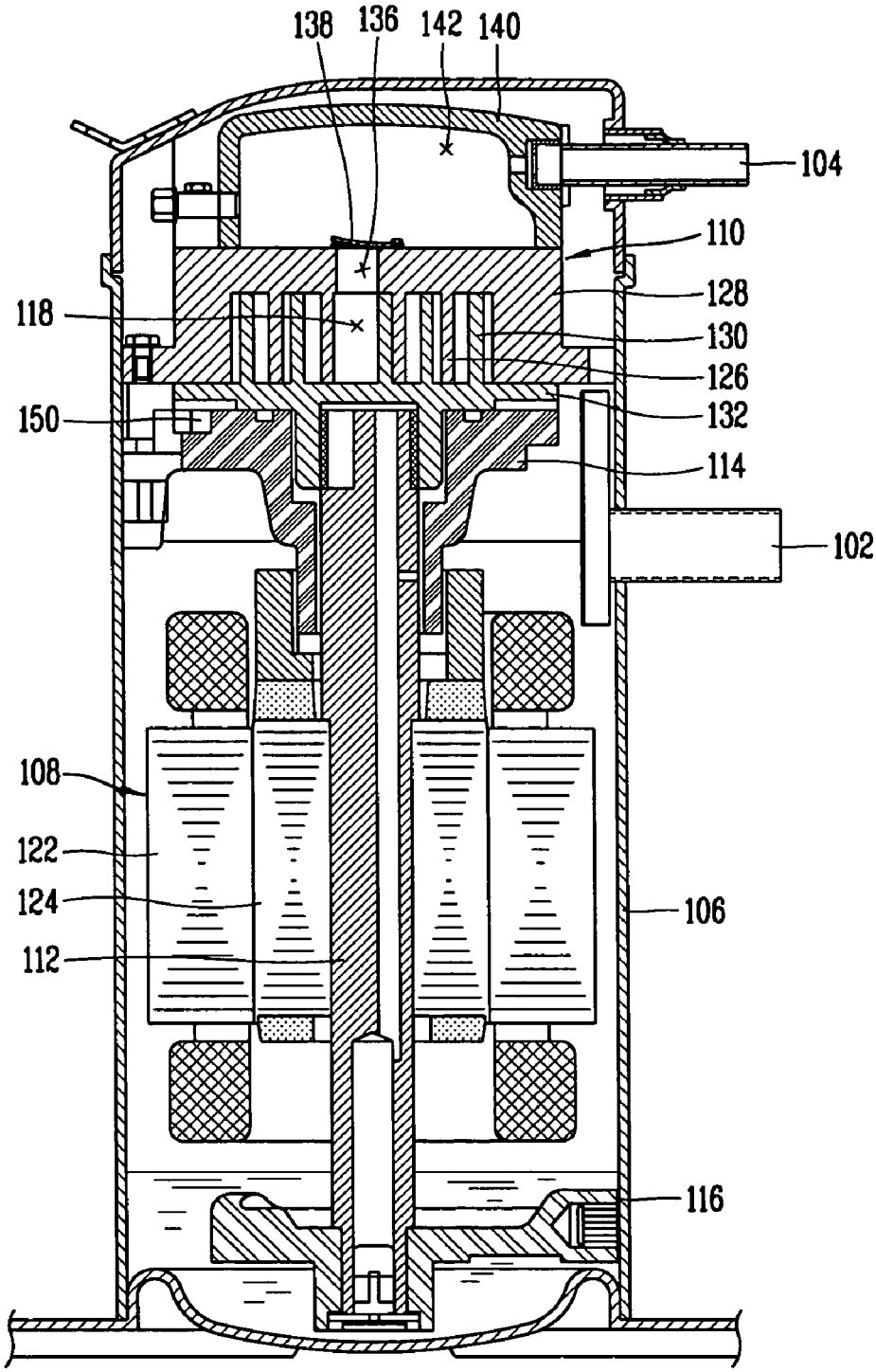
FIG. 1 BACKGROUND ART
FIG. 1 is a sectional view of a scroll compressor in accordance with a conventional art.
Figure 2:
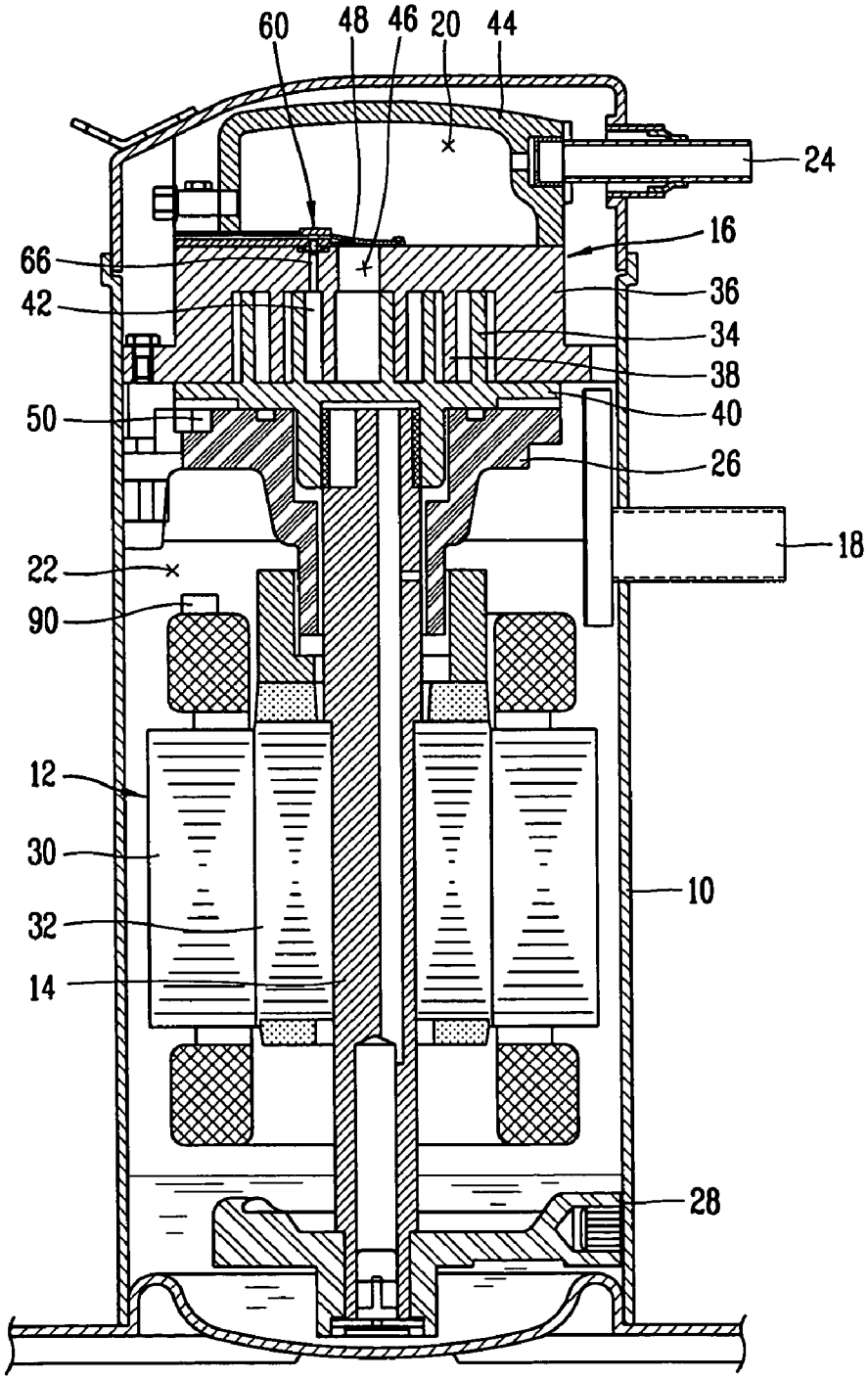
FIG. 2 is a sectional view of a scroll compressor in accordance with the present invention.

FIG. 2 is a sectional view of a scroll compressor in accordance with the present invention.

As shown in FIG. 2, the scroll compressor of the present invention includes: casing 10 having a closed space; a driving motor 12 installed in the casing 10 and generating a driving force; a compression unit 16 connected with the driving motor 12 by a rotating shaft 12, and compressing a fluid and discharging it outwardly when the driving motor is driven; and an overheat preventing unit 60 installed at one side of the compression unit 16, sensing a temperature of the gas compressed in a compressing chamber 42 of the compression unit 16, and bypassing a high temperature and high pressure gas of a high pressure chamber 20 to a low pressure chamber 22 to protect a compressor when the gas temperature goes up beyond a pre-set value.

A suction pipe 18 through which a gas is sucked and a discharge pipe 24 through which a compressed gas is discharged are connected to the casing 10. Inside the casing 10, there are provided a main frame 26 which rotatably supports the rotating shaft 14 and the compression unit 16, and a lower frame 28 which rotatably supports a lower end of the rotating shaft 14.

The driving motor 12 includes a stator 30 fixed at an inner circumferential surface of the casing 10 and a rotor 32 disposed at the inner circumferential surface of the stator 30 and fixed at the rotating shaft 14. Accordingly, when power is applied to the stator 30, the rotor 32 is rotated according to interaction between the stator 30 and the rotor 32, to thereby rotate the rotating shaft 14.

A motor protecting unit 90 is installed at an upper end of the stator 30 in order to be heated by a high temperature and high pressure gas introduced form the high pressure chamber 20 to the lower pressure chamber 22 according to operation of the overheat preventing unit in order to stop an operation of the compressor.

In other words, the motor protecting unit 90 stops the operation of the compressor to protect the stator 30 of the driving motor 12 when it is heated by the high temperature and high pressure bypassed from the high pressure chamber 20 to the low pressure chamber 22.

The compression unit 16 includes a fixed scroll 36 having an involute-shaped fixed vane 34 and fixed at an upper portion of the casing 10; an orbiting scroll 40 having an involute-shaped orbiting vane 38 corresponding to the fixed vane 34 so as to have the compressing chamber 42 therebetween, and orbitingly supported by the main frame 26 so as to make an orbiting movement when the rotating shaft 14 is rotated; and a muffler 44 fixed at an upper surface of the fixed scroll 36 to form the high pressure chamber 20 to which the fluid is discharged after being compressed in the compressing chamber 42, connected to the discharge pipe 24, and reducing noise generated from the fluid being discharged.

An exhaust hole 46 is formed at the center of the fixed scroll 36 in order to exhaust the gas compressed according to interaction between the fixed vane 34 and the orbiting vane 38 to the high pressure chamber 20.

A check valve 48 is installed at an upper side of the fixed scroll 36 in order to prevent backflow of the fluid by opening or closing the exhaust hole 46.

An oldhamring 50 for preventing rotation of the orbiting scroll 40 is installed between the orbiting scroll 40 and the main frame 26.

Figure 3:
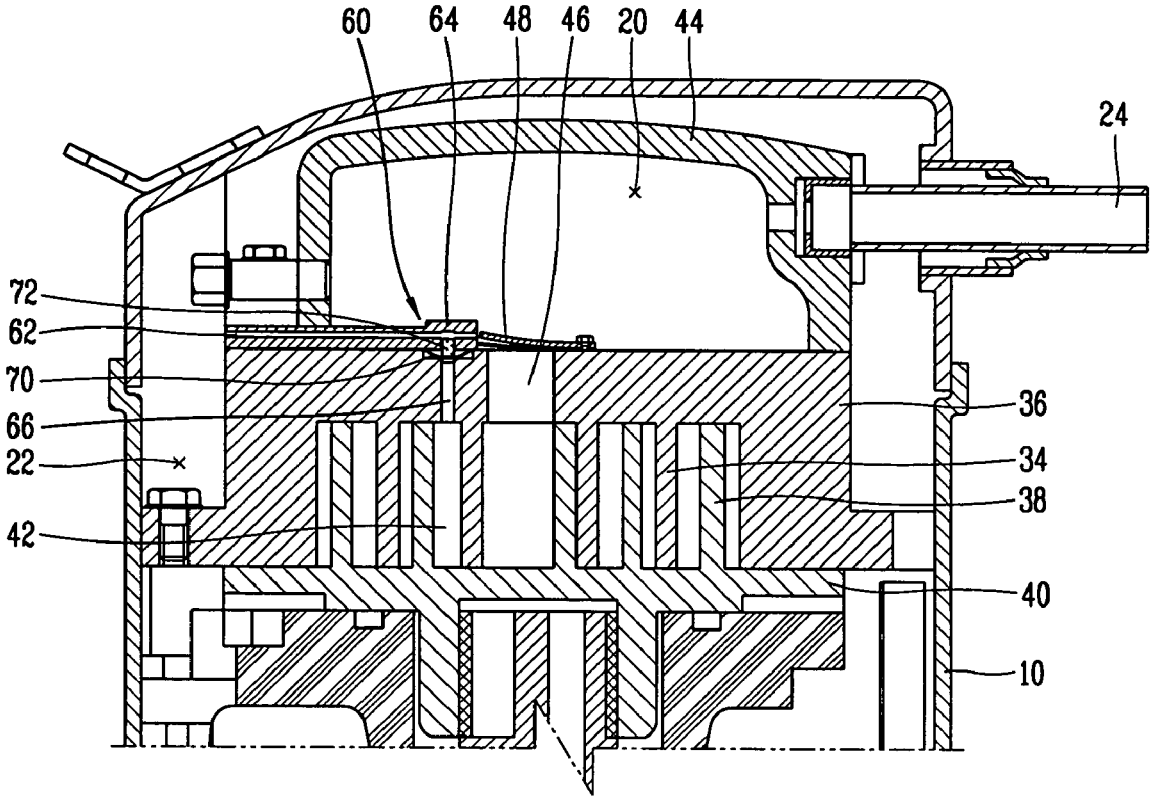
FIG. 3 is a sectional view showing a compression unit of the scroll compressor in accordance with the present invention.
Figure 4:
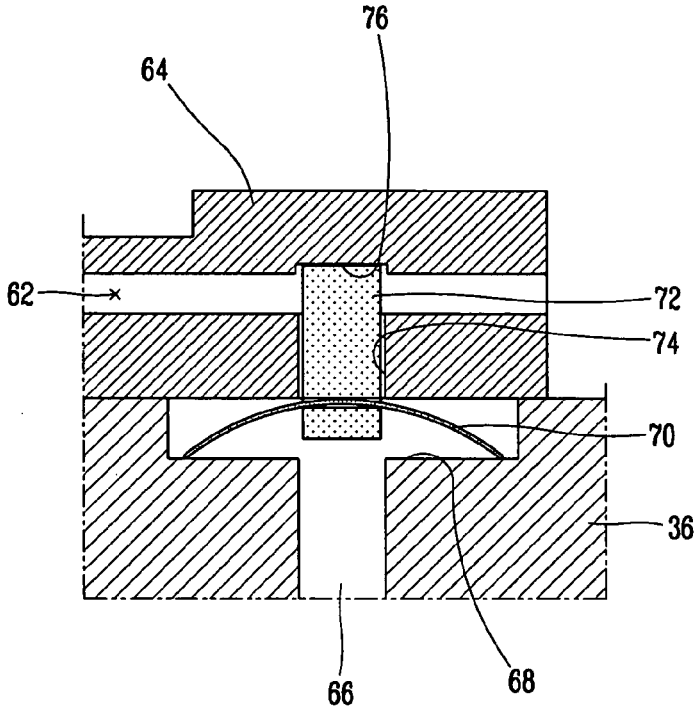
FIG. 4 is a sectional view showing an overheat preventing unit of the scroll compressor in accordance with the present invention.

As shown in FIGS. 3 and 4, the overheat preventing unit 60 includes a passage member 64 disposed at the upper surface of the fixed scroll 36 and having a bypass passage 62 making the high pressure chamber 20 and the low pressure chamber 22 communicated with each other; and a valve assembly mounted at the fixed scroll 36, sensing a temperature of the gas compressed in the compressing chamber 42, and opening the bypass passage 62 if the sensed gas temperature goes up beyond a pre-set temperature.

The passage member 64 is mounted at the upper surface of the fixed scroll 36 and disposed to penetrate the muffler 44, so that one end thereof is positioned inside the high pressure chamber 20 and the other end is positioned at the lower pressure chamber 22. The passage member 64 includes the bypass passage 62 for bypassing the high temperature and high pressure gas of the high pressure chamber 20 to the low pressure chamber 22 in a longitudinal direction.

The valve assembly includes a channel 66 formed at the fixed scroll 36 in a vertical direction and connected with the compressing chamber 42 in which a gas is compressed; a mounting groove 68 communicating with the channel 66 and formed at an upper surface of the fixed scroll 36; a thermally-distorted member 70 installed in the mounting groove and thermally distorted when the temperature of the gas compressed in the compressing chamber 42 goes up beyond the pre-set temperature; and a valve member 72 mounted at the thermal distortion member 70 and opening the bypass passage 62 when the thermal distortion member 70 is thermally distorted.

The compressing chamber 42 has a spiral form by the fixed vane 34 and the orbiting vane 38, and has such a structure that its outer portion has a relatively low compression force and as it goes toward the center of the compressing chamber 42, compression force is heightened. Thus, the channel 66 is connected to a portion of the compressing chamber 42 in which a gas is compressed to some intermediate pressure and senses a temperature of the gas when the gas is compressed to the intermediate pressure to operate the thermal distortion member 70.

The thermal distortion member 70 is formed in a disk type with its central portion formed convex. The valve member 72 is mounted at the center of the thermal distortion member 70. When the gas in the compressing chamber 42 that has been introduced through the channel 66 goes up beyond the pre-set temperature, the center becomes concave and moves the valve member 72 in a longitudinal direction.

Preferably, the thermal distortion member 70 is formed as a bi-metal type so that the convex portion thereof can be deformed concave when heat of a certain temperature is applied thereto.

A guide groove 74 is formed at the passage member 64 in which the valve member 72 is inserted to be movable linearly, and a groove 76 is formed at an inner circumferential surface of the bypass passage 62 of the passage member 64, in which the outer circumferential surface of the passage member 64 is inserted in a circumferential direction.

Namely, when the valve member 72 is linearly moved, it is inserted into the groove 76 formed at the inner circumferential surface of the bypass passage 62 to close the bypass passage 62.

A lower portion of the valve member 72 is fixed at the thermal distortion member 70 and mounted to be movable in the longitudinal direction at the guide groove 74 formed at the passage member 64, so that the valve member 72 can be linearly moved according to an operation of the thermal distortion member 70 to open or close the bypass passage 62.

The operation of the scroll compressor constructed as described above will be explained as follows.

Figure 5:
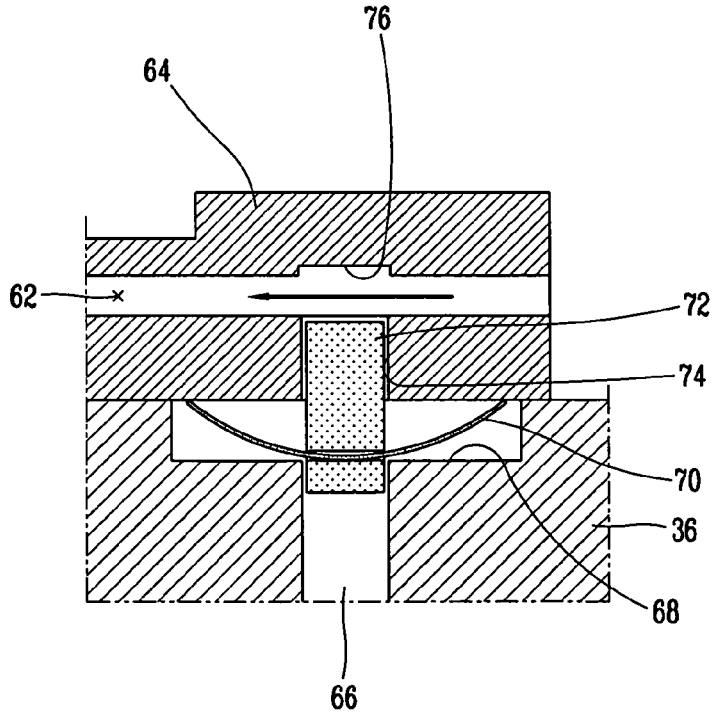
FIG. 5 shows an operational state of the overheat preventing unit of the scroll compressor in accordance with the present invention.

FIG. 5 shows an operational state of the overheat preventing unit of the scroll compressor in accordance with the present invention.

In case that the compressor operates normally, power is applied to the driving motor 12, the rotating shaft 14 is rotated, and the orbiting scroll 40 is orbited according to rotation of the rotating shaft 14 to compress the fluid sucked into the compressing chamber 42 according to interaction between the orbiting scroll 40 and the fixed scroll 36 and discharge the compressed fluid to the high pressure chamber 20 through the exhaust hole 46. The highly pressed gas in the high pressure chamber 20 is discharged externally through the discharge pipe 24.

During the operation of the scroll compressor, if the gas compressed in the compressing chamber 42 goes up beyond the pre-set temperature, the overheat preventing unit 60 operates to bypass the high temperature and high pressure gas in the high pressure chamber 20 to the low pressure chamber 22 to maintain the temperature inside the high pressure chamber 20 to a proper level, thereby protecting the compressor.

The operation of the overheat preventing unit will now be described in detail.

When the gas compressed in the compressing chamber 42 maintains a normal temperature, the thermal distortion member 70 has such a form that it is convex upwardly as shown in FIG. 4 so that the valve member 72 is maintained in a state of being moved in the upward direction, maintaining the bypass passage 62 closed.

In this state, if the gas compressed in the compressing chamber 42 goes up beyond the pre-set temperature, the gas inside the compressing chamber 42 flows to the thermal distortion member 70 through the channel 66 to distort the thermal distortion member 70 concave at its center, to thereby move the valve member 72 linearly in a downward direction.

Then, the valve member 74 is released from the groove 74 formed at the bypass passage 62 to open the bypass passage 62, and accordingly, the high temperature and high pressure gas of the high pressure chamber r20 is bypassed to the low pressure chamber 22 through the bypass passage 62 to thereby protect the compressor.

When the high temperature and high pressure gas is introduced into the low pressure chamber 22 through the bypass passage 62, the motor protecting unit 90 installed at the upper end of the stator 30 of the driving motor 12 is heated and operated to stop the operation of the compressor.

At this time, since the compressor is stopped, the temperature and pressure of the gas inside the compressing chamber 42 are lowered, and thus, the thermal distortion member 70 returns to its original state of being convex in the upward direction. Then, the valve member 72 is raised to close the bypass passage 62.

As so far described, the scroll compressor in accordance with the present invention has many advantages.

When the temperature of the gas in the compressing chamber goes up beyond the pre-set temperature while the compressor is operating, the valve assembly is operated to open the bypass passage to bypass the high temperature and high pressure gas in the high pressure chamber to the low pressure chamber, thereby protecting the compressor and enhancing reliability of the compressor.

In addition, the temperature of the gas being compressed in the compressing chamber is sensed and the opening and closing operation of the bypass passage is made according to the temperature of the gas, so that the operation of the compressor can be more accurately performed and damage of the overheat preventing unit can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a casing including a high pressure chamber and a low pressure chamber;

a driving motor installed in the casing, the driving motor configured to generate a driving force;

a rotating shaft;

a compression unit including a muffler, a fixed scroll, and a compression unit compressing chamber, the compression unit connected to the driving motor by the rotating shaft, the compression unit configured to compress and externally discharge a gas when the driving motor is driven; and an overheat preventing unit configured to sense a temperature of a gas at an intermediate pressure location of the compression unit compressing chamber, and to bypass gas from the high pressure chamber to the low pressure chamber if a sensed temperature of the gas at the intermediate pressure location exceeds a pre-set value, the overheat preventing unit comprising:

a passage member attached to an upper surface of the fixed scroll and containing a bypass configured to connect the high pressure chamber to the low pressure chamber, a thermal distortion member configured to be thermally distorted when the temperature of the gas compressed at the intermediate pressure location increases beyond the pre-set value, a channel connecting the intermediate pressure location to the thermal distortion member, and a valve member attached to the thermal distortion member and configured to open the bypass passage when the thermal distortion member is thermally distorted in a first concave position, the valve member blocking the bypass passage when the thermal distortion member is not thermally distorted and in a second concave position opposite to the first concave position.

2. The compressor of claim 1, further comprising:

a stator; and a motor protection unit disposed on an upper surface of the stator and configured to stop an operation of the compression unit after high temperature and high pressure gas of the high pressure chamber flows into the low pressure chamber.

3. The compressor of claim 1, wherein the valve member comprises a cylinder attached to a center of the thermal distortion member.

4. The compressor of claim 3, wherein the channel comprises:

a straight channel formed in the fixed scroll in a direction parallel to the rotating shaft.

5. The compressor of claim 4, wherein the overheat preventing unit comprises:

a mounting groove housing the thermal distortion member and formed in an upper surface of the fixed scroll at an upper end of the straight channel, the mounting groove having a diameter wider than a diameter of the straight channel.

6. The compressor of claim 5, wherein the overheat preventing unit comprises:

a guide groove formed in a lower wall of the passage member directly above the upper end of the straight channel, the guide groove being concentric with the straight channel.

7. The compressor of claim 6, wherein the overheat preventing unit comprises:

a groove concentric with the straight channel and formed in an upper wall of the passage member directly above the upper end of the straight channel.

8. The compressor of claim 7, wherein the cylinder is concentric with the straight channel, and is configured to move linearly within the guide groove and the groove.

9. The compressor of claim 8, wherein the cylinder comprises:

an upper surface configured to close the bypass passage by resting within the groove when the thermal distortion member is thermally distorted in the first concave position.

10. The compressor of claim 9, wherein the thermal distortion member is formed as a bi-metallic disk.

* * * * *